US005916106A

United States Patent [19]

Chen

[11] Patent Number: 5,916,106

[45] Date of Patent: Jun. 29, 1999

[54] CAP-FOLDING AND SEALING MACHINE FOR COMMON OR RETRIEVED CARTONS

[75] Inventor: Tuan-Mei Chiu Chen, Chia-Yi Hsien, Taiwan

[73] Assignee: Tien Heng Machinery Co., Ltd., Chia-Yi Hsien, Taiwan

[21] Appl. No.: 08/995,134

[22] Filed: Dec. 19, 1997

[51] Int. Cl.[6] ..... B65B 61/00

[52] U.S. Cl. ..... 53/136.4; 53/168; 53/377.2; 53/378.3

[58] Field of Search ..... 53/136.4, 376.4, 53/377.2, 377.6, 378.3, 168; 242/559, 559.3, 559.4, 560, 560.1

[56] References Cited

U.S. PATENT DOCUMENTS

| | | | |
|---|---|---|---|
| 4,262,469 | 4/1981 | Ooms et al. | 53/136.4 |
| 4,543,150 | 9/1985 | Marchetti | 53/136.4 |
| 5,060,451 | 10/1991 | DeMay et al. | 53/201 |
| 5,323,586 | 6/1994 | Lissoni et al. | 53/136.4 |
| 5,595,043 | 1/1997 | Radigan | 53/377.6 |
| 5,685,814 | 11/1997 | Le | 53/378.3 |

*Primary Examiner*—Daniel B. Moon
*Assistant Examiner*—Steven Jensen
*Attorney, Agent, or Firm*—Rosenberg, Klein & Bilker

[57] ABSTRACT

A cap-folding and sealing machine for common or retrieved cartons includes a table, a folding device, a first cap frame, a second cap frame, and a double sealing device. The folding device includes upper swing rod units, a side pressing unit, and a folding guiding arm for swinging and folding a front cap, a rear cap, and two side caps with help of the first cap frame after a carton is moved into the table. Then the carton is moved into the second cap frame and the double sealing device, which seals the upper and the lower side with adhesive tapes by means of two pairs of upper main and lower main sealing members of the double sealing device. The two pairs of the sealing members alternately perform sealing operation so that sealing may be kept on continuously without stopping the machine for replacing adhesive tapes even when used up or ripped off.

13 Claims, 14 Drawing Sheets

CAP-FOLDING AND SEALING MACHINE FOR COMMON OR RETRIEVED CARTONS

BACKGROUND OF THE INVENTION

This invention concerns a cap-folding and sealing machine for common or retrieved cartons, particularly arranged on a table for automatically performing cap-folding and sealing adhesive tapes on the caps, shortening time needed for those operations. In addition, it can handle cartons of different size.

Common conventional cap-folding and sealing machines for automatically performing smooth cap-folding and sealing adhesive tapes on the caps folded include only one single sealing device so that the whole machine may have to be stopped if adhesive tapes are used up or ripped off and have to be replaced with new ones. In addition, if retrieved cartons are to be used, their four caps usually droop down to cause difficulty in swinging up them to fold on the upper opening of the carton.

SUMMARY OF THE INVENTION

A purpose of the invention is to offer a cap-folding and sealing machine for common or retrieved cartons, consisting of a table with a conveyor, a cap folding device, and a double tape sealing device so that a carton filled with contents may have its position corrected, folded with the four caps, and then adhered with tapes on the caps in a continuous manner for lowering cost for packaging.

Another purpose of the invention is to offer a cap-holding and sealing machine for common or retrieved cartons, including push arms of a push arm unit for swinging a drooping-down front cap from a very low position upward to a regular height so as to be folded down.

Another purpose of the invention is to offer a cap-folding and sealing machine for common or retrieved cartons, including swing rods of an upper swing rod unit for swinging a drooping-down rear cap from a very low position upward to a regular height so as to be folded down.

Another purpose of the invention is to offer a cap-folding and sealing machine for common or retrieved cartons, including a first cap frame and a second cap frame for swinging upward two side caps to be folded down.

One more purpose of the invention is to offer a cap-folding and sealing machine for common or retrieved cartons, including a double sealing device consisting of two upper sealing units and two lower sealing units alternately performing sealing operation without need of stopping the whole machine even if the adhesive tapes of the one sealing unit are used up, by means of sensors for sensing if adhesive tapes are used up or ripped off.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
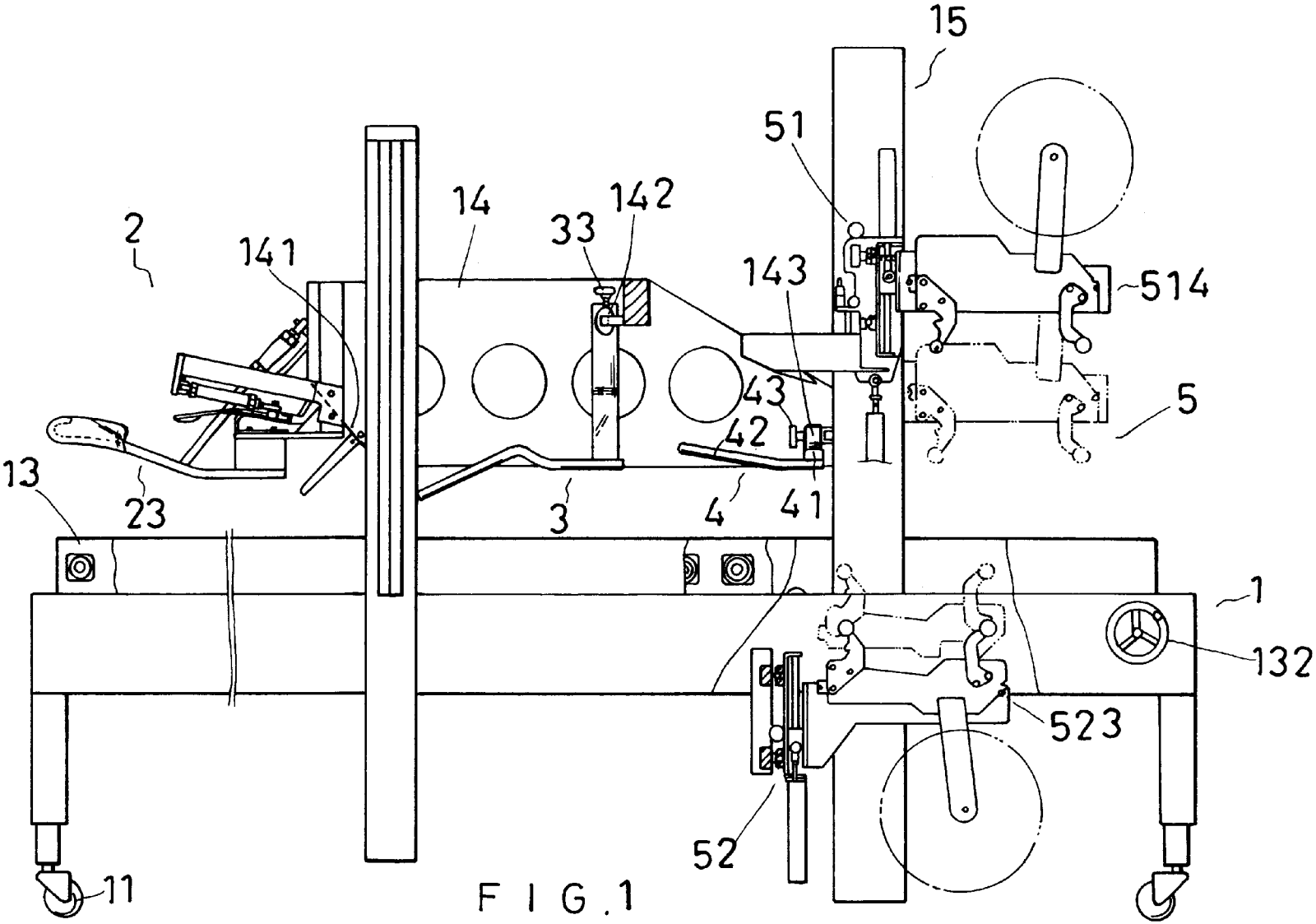
FIG. 1 is a side view of a cap-folding and sealing machine for common or retrieved cartons of the present invention.
Figure 2:
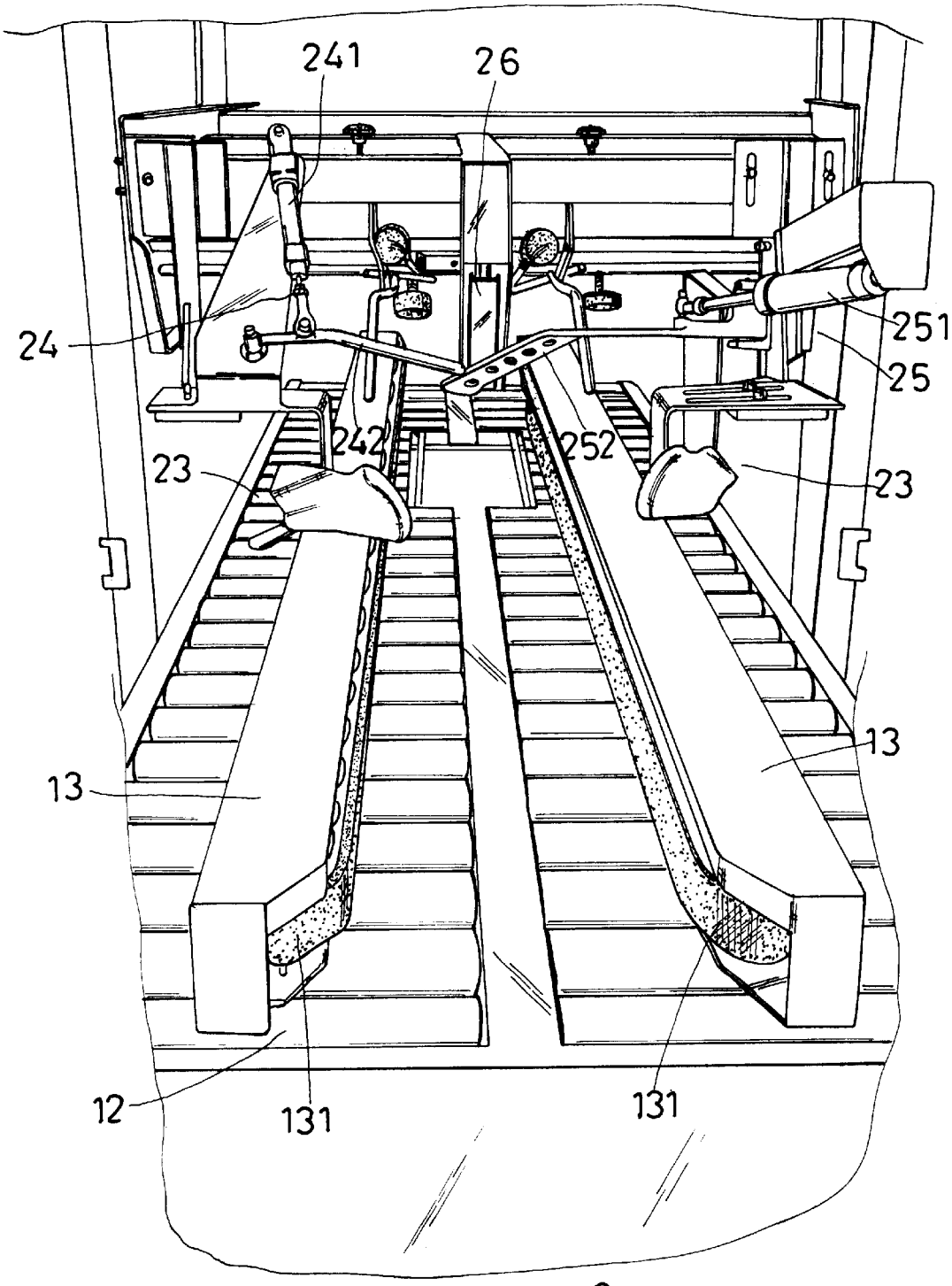
FIG. 2 is a perspective view of an entrance of the cap-folding and sealing machine for common or retrieved cartons of the present invention.

A preferred embodiment of a cap-folding and sealing machine for common or retrieved cartons in the present invention, as shown in FIG. 1, includes a table 1, a folding device 2, a first and a second cap frame 3 and 4, and a double sealing device 5 combined together.

Figure 3:
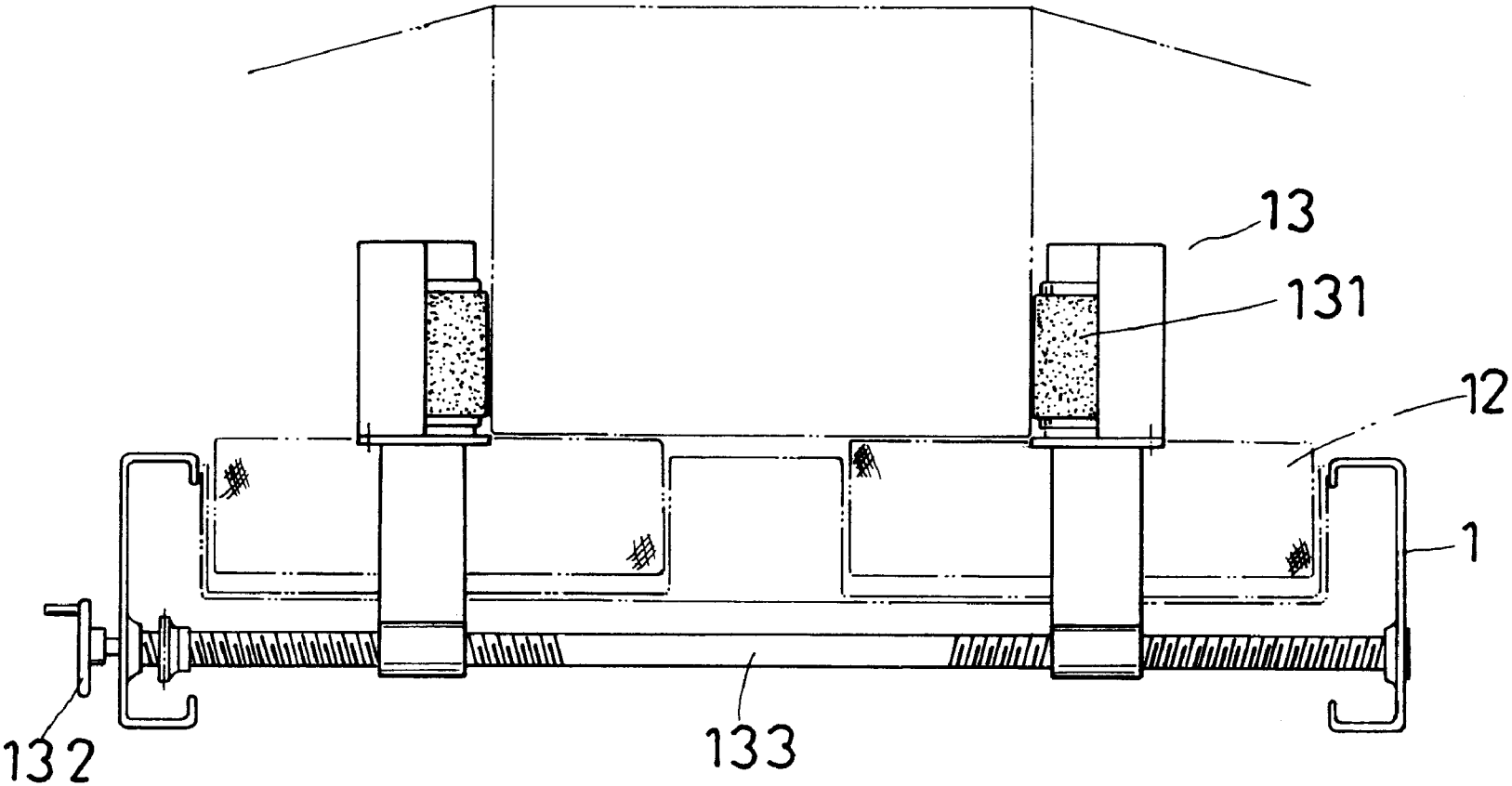
FIG. 3 is a side view of an expanding device of a holding frame of a table of the present invention.

The table 1 is of a preset shape, having castors 11 provided at the ends of feet, a plurality of rollers 12 disposed spaced apart on an upper surface, a pair of holding frames 13 disposed parallel on the rollers 12, with a conveyer belt 131 movably mounted on an inner side of each holding frame 13, a threaded long rod 133 provided laterally below the pair of holding frames 13 and having right-direction threads formed in a right end section and left-direction threads formed in a left end section, an adjusting wheel 132 fixed at a left end of the threaded long rod 133 to rotate the rod 133 for adjusting the hollow distance between the two holding frames 13, 13 so as to correspond different width of a carton, as shown in FIG. 3.

For assembling the folding device 2, and the first and the second cap frame with the table 1, an upper frame 14 is provided, having a sloping down surface 141 formed in a front side, a pair of first guide rods 142, 142 fixed at an intermediate portion, and a pair of second guide rods 143, 143 fixed at a rear end. For assembling the double sealing device 5, a rear frame 15 is provided at the rear side of the table 1.

Figure 4:
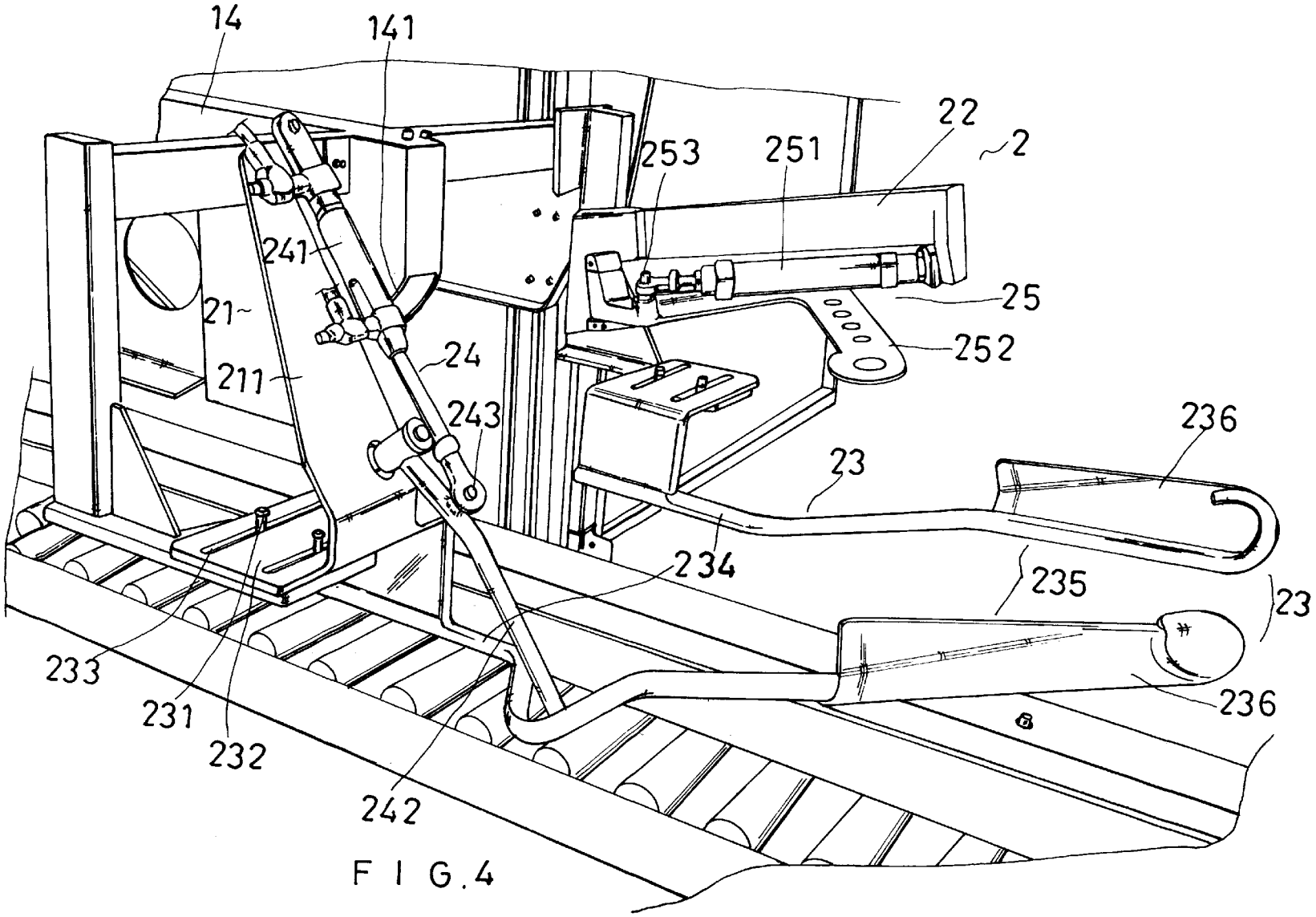
FIG. 4 is a perspective view of a folding device of the present invention.
Figure 5:
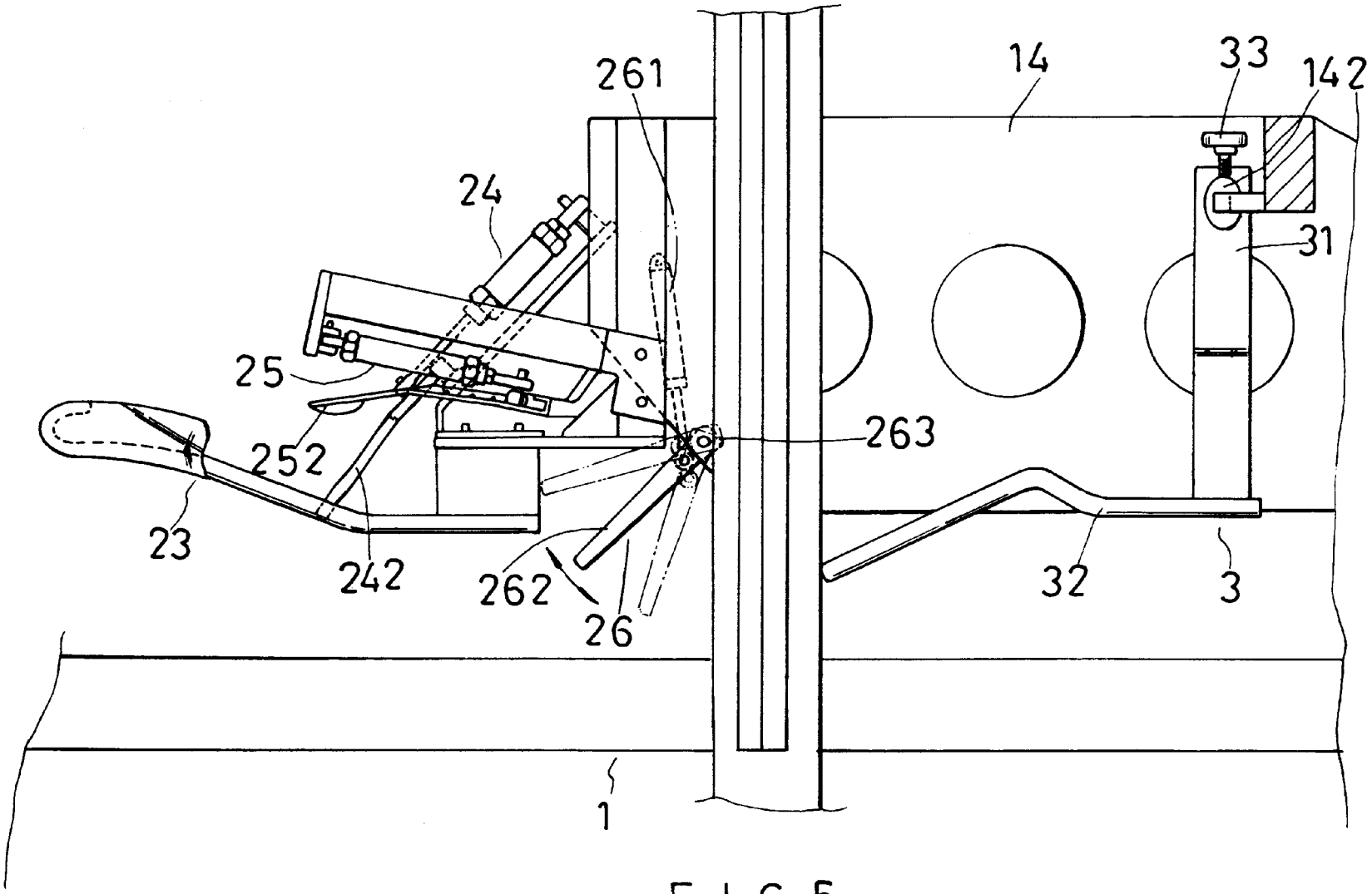
FIG. 5 is a side view of the folding device combined with a first cap frame of the present invention.

The folding device 2 as shown in FIGS. 4 and 5 in addition to FIGS. 1, is assembled with the front end of the upper frame 14, consisting of a combine plate 21, a combine frame 22, a pair of folding guide rods 23, an upper folding unit 24, a side pressing unit 25 and a folding guide frame 26.

The combine plate 21 and the combine frame 22 are mounted fixedly on two sides of the front end of the upper frame 14. The combine plate 21 has a sloping-forward-down surface 211.

The pair of folding guide rods 23, 23 are located at the right and the left side, the left folding guide rod 23 is located below the combine plate 21, and the right folding guide rod 23 is located below the combine frame 22. The distance between the right and the left folding guide rods 23, 23 can be adjusted by two thumb screws 231 fitting and movable in long slots 233, 233 in position plates 232, 232. Each folding guide rod 23 has a proximal straight portion 234, a little upward intermediate portion and a distal curved-back end portion 235 and a vertical plate 236 fixed on a partial intermediate portion and the distal curved-back end portion 235 for folding operation.

The upper folding unit 24 consists of a first air cylinder 241 and a swing rod 242. The first air cylinder 241 is mounted on the upper frame 14, having a piston rod connected with the swing rod 242 with a pivot 242. An inner end of the swing rod 242 is pivotally connected with the combine plate 21 so that the swing rod 242 may be swung upward to raise a rear cap 63 of a carton to a preset height.

The side pressing unit 25 consists of a second air cylinder 251 and a press arm 252. The second air cylinder 251 is fixed on an inner side of the combine frame 22, and the press arm 252 is nearly shaped as L and slightly sloping downward, having its inner end pivotally connected with the combine frame 22 so that the press arm 252 may extend inward to press down a rear cap 63 in time by operation of the second air cylinder 251.

The folding guide arm 26 consists of a third air cylinder 261 and a push arm 262. The third air cylinder 261 has its inner end fixed in a hollow body of the upper frame 14 and the outer end of its piston rod pivotally connected with an inner end of the push arm 262. An outer end of the push arm 262 can be swung upward with a pivot 263 connecting the end of the piston rod with the push arm 262 to raise a front cap of a carton to a preset height.

The first cap frame 3 consists of a pair of vertical plates 31, 31 connected respectively with a cap press rod 32 as integral, with an upper end of each vertical plate 31 insertedly combined with a guide rod 142 of the upper frame 14. The lower end of each vertical plate 31 is connected with the cap press rod 32 in a right angle so as to let the cap press rod 32 extend forward and a little outward and further sloping down for a proper angle. The distance between the pair of the vertical plates 31, 31 may be adjusted by means of a thumb screw 33 slidable on the first guide rod 142.

The second cap frame 4, referring to FIG. 1, consists of a pair of position plates 41, 41 connected respectively with a guide rod 42 as integral. An upper end of each position plate 41 is insertedly combined with each second guide rod 143 of the upper frame 14, and a lower end of each position plate 41 is connected with an inner end of each guide rod 42 extending forward and outward. Further, the distance between the two guide rods 42, 42 may be adjusted by means of two thumb screws 43, 43 fixed respectively with an upper end of each position plate 41 and disposed movably on each second guide rod 143 of the upper frame 14.

Figure 6:
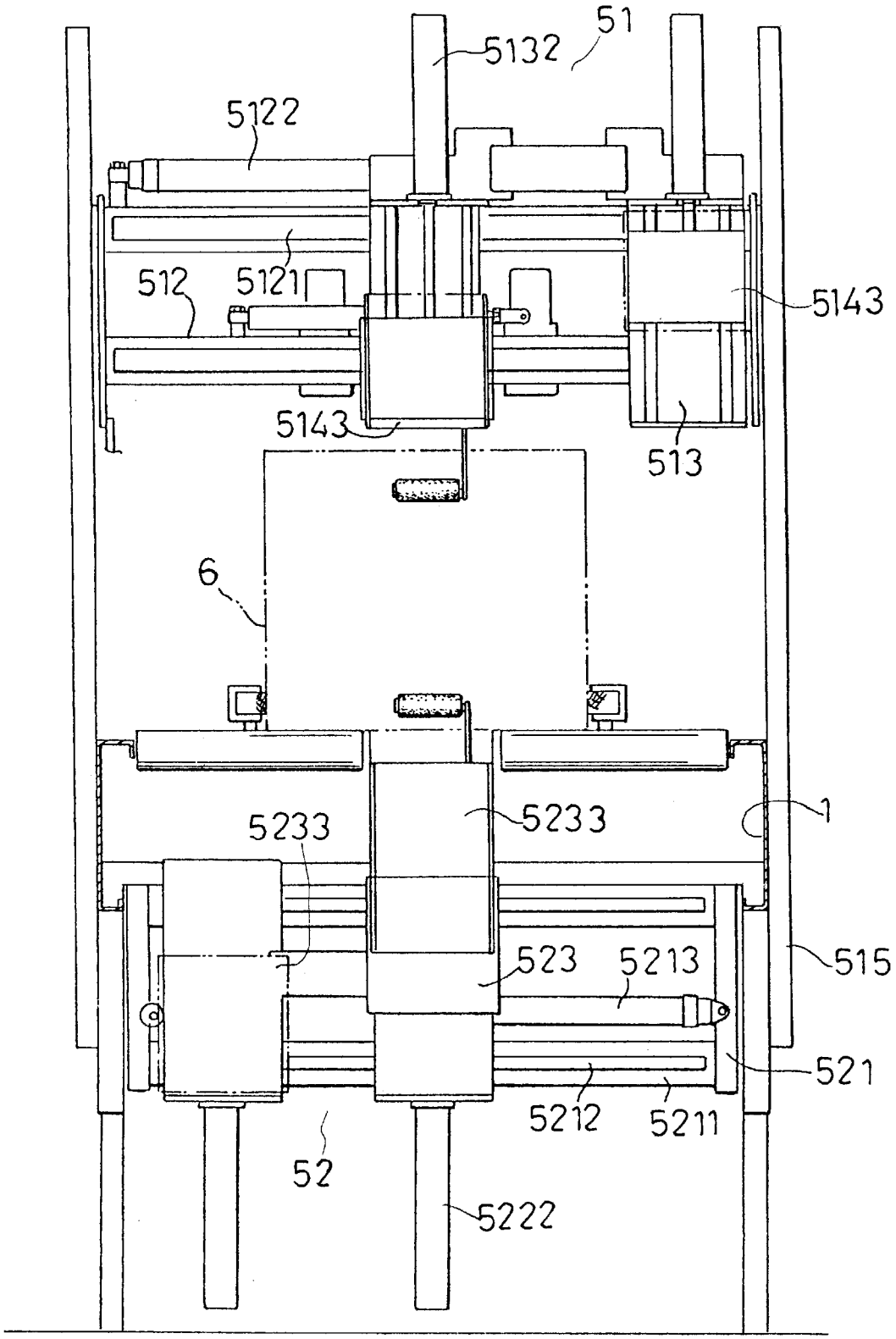
FIG. 6 is a side view of a double sealing device of the present invention.

The double sealing device 5 as shown in FIG. 6, includes an upper slide base 51, a lower position base 52.

Figure 7:
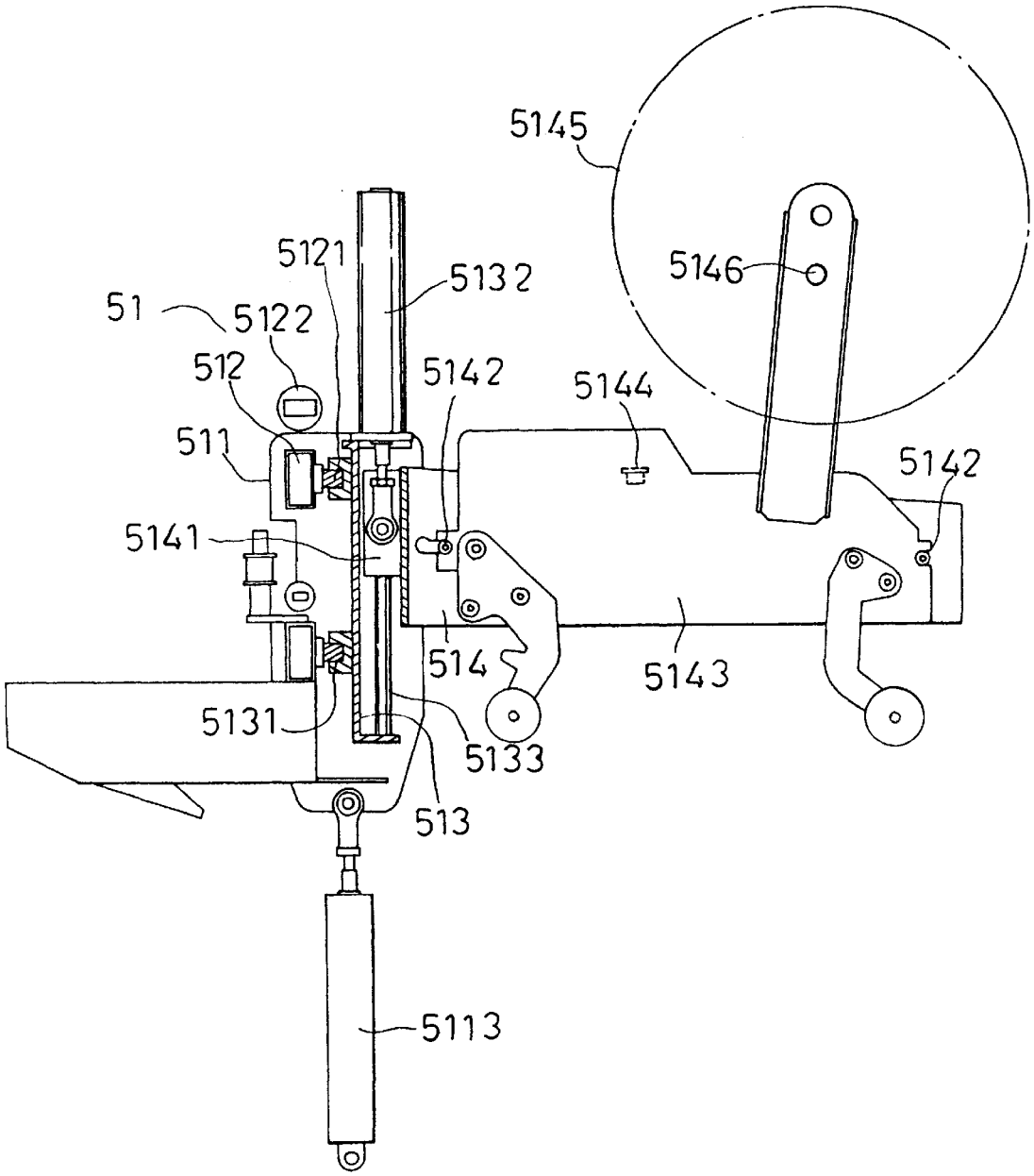
FIG. 7 is a front view of an upper slide base of the double sealing device of the present invention.
Figure 8:
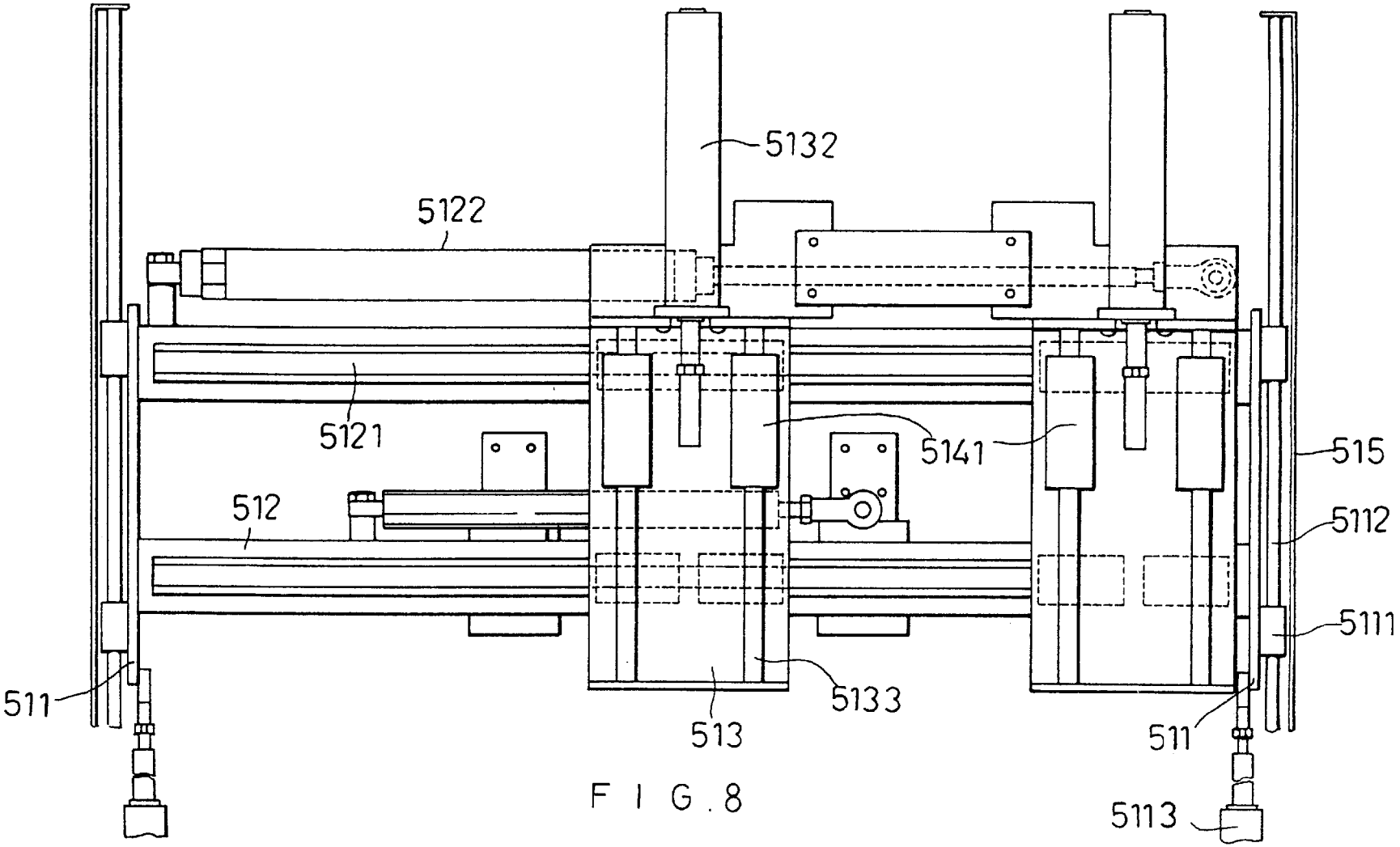
FIG. 8 is a side view of the upper slide base of the double sealing device of the present invention.

The upper slide base 51 consists of two side plates 511, 511, two lateral frames 512, two slide seat 513, 513, and two upper cases 514, 514, also referring to FIGS. 7 and 8. The two side plates 511, 511 are fixed respectively with the two ends of each lateral frame 512, respectively having a sliding sleeve 5111 for a first slide rod 5112 of a rod frame 515 to pass through so that the whole upper slide base 51 may be lifted and lowered by means of two fourth air cylinders 5113 located on the bottom of said upper slide base 51. Each lateral frame 512 has a guide rail 5121 for the slide base 5131 behind the slide seat 513 to combine with and slide along. Further, a fifth air cylinder 5122 is mounted on the lateral frame 512 for moving the whole slide seat 513. A sixth air cylinder 5132 is fixed respectively on the slide seat 513 and connected with each upper case 514, which is then moved up and down by means of a second slide rod 5133. Each upper case 514 contains two support rods 5142, 5142 for fixing each upper main sealing member 5143 thereon. A socket 5144 is disposed on a proper location on each main sealing member 5143 for connecting a sensor 5146 for sensing an adhesive tape 5145 if it is used up or ripped off.

Figure 9:
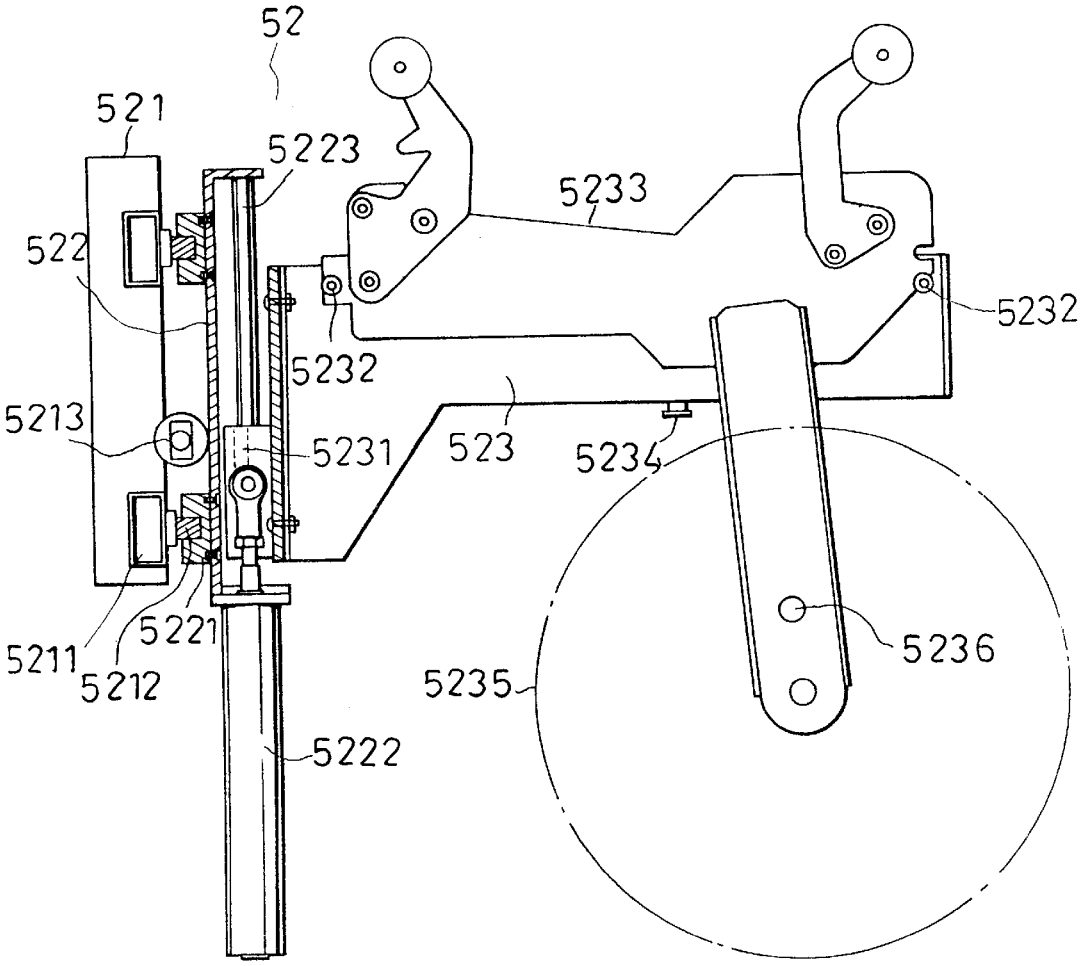
FIG. 9 is a front view of a lower position base of the double sealing device of the present invention.

The lower base 52 consists of two plate frames 521, 521, two slide plates 522, 522 and two lower cases 523, with FIG. 9 additionally referred. Each plate frame 521 is fixed with the table 1, having two lateral frames 5211, 5211, a guide rail 5212 fixed on rear side of each lateral frame 5211 and fitting with a sliding sleeve 5221 of each slide seat 522, a sixth air cylinder 5213 fixed respectively on a rear side of each lateral frame 521 for moving the slide seat 522. A seventh air cylinder 5222 is provided respectively under each slide plate 522, fixed with each lower case 523, and a sliding sleeve 5231 is fixed on a rear side of each lower case 523 and combined with a slide rod 5223 of the slide seat 522 so that each lower case 523 may be lifted up and lowered down by the two seventh air cylinder 5222. In each lower case 523 is supported a lower main sealing member 5232 by two support rods 5232, 5232, and a socket 5234 is fixed on a lower side of the lower case 523 for a sensor 5236 to insert and sense a adhesive tape 5235 if it is used up or ripped off.

After the cap-folding and sealing machine for cartons is assembled together, it will automatically fold and seal caps, with products already placed in their interior by means of a packaging machine. Next, how the cap-folding and sealing operation is performed by this cap-folding and sealing machine is described as follows.

Figure 10:
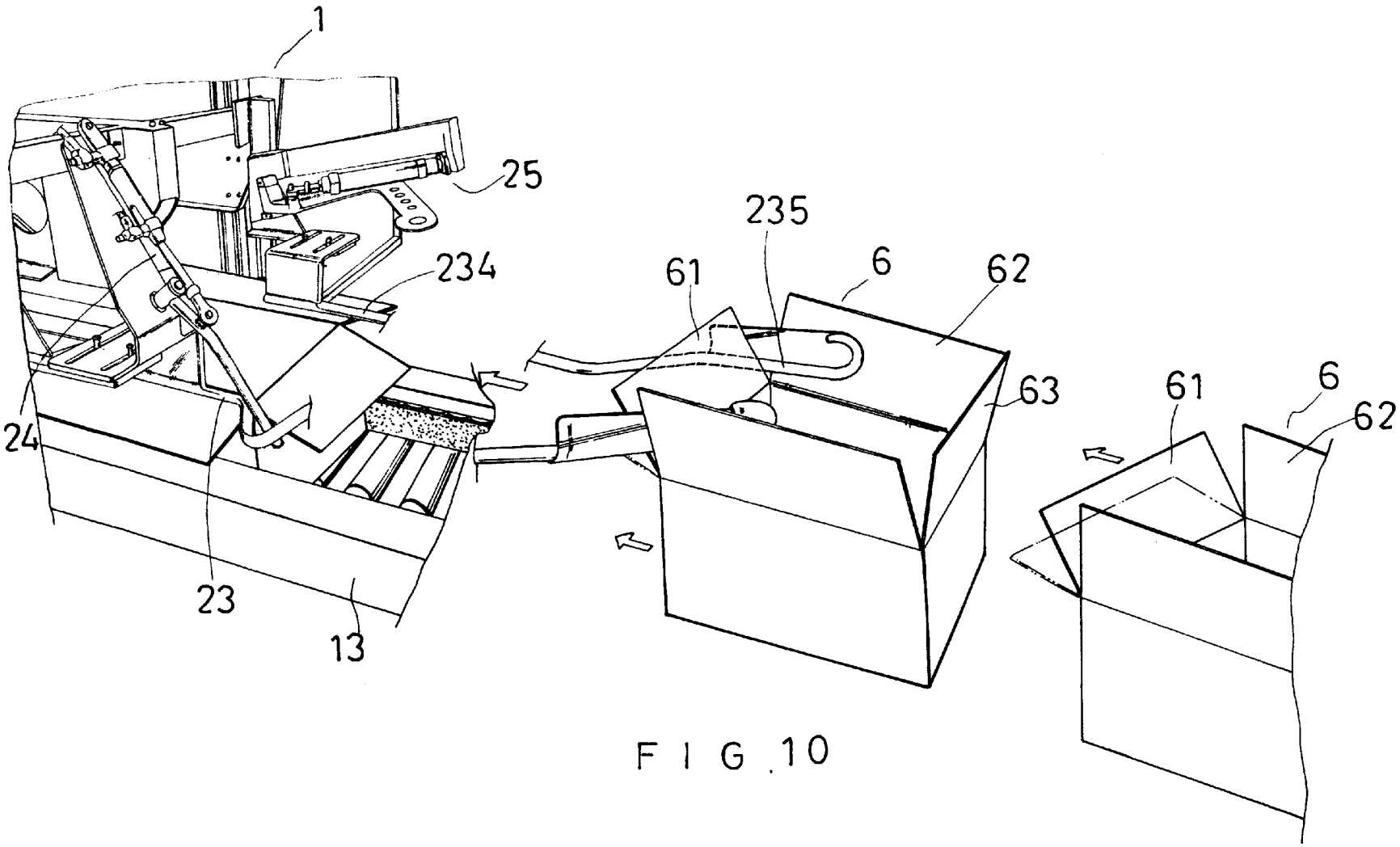
FIG. 10 is a perspective view of folding guide rods of the folding device of the present invention, showing it inserting through the gaps between a front cap and two side caps.
Figure 11:
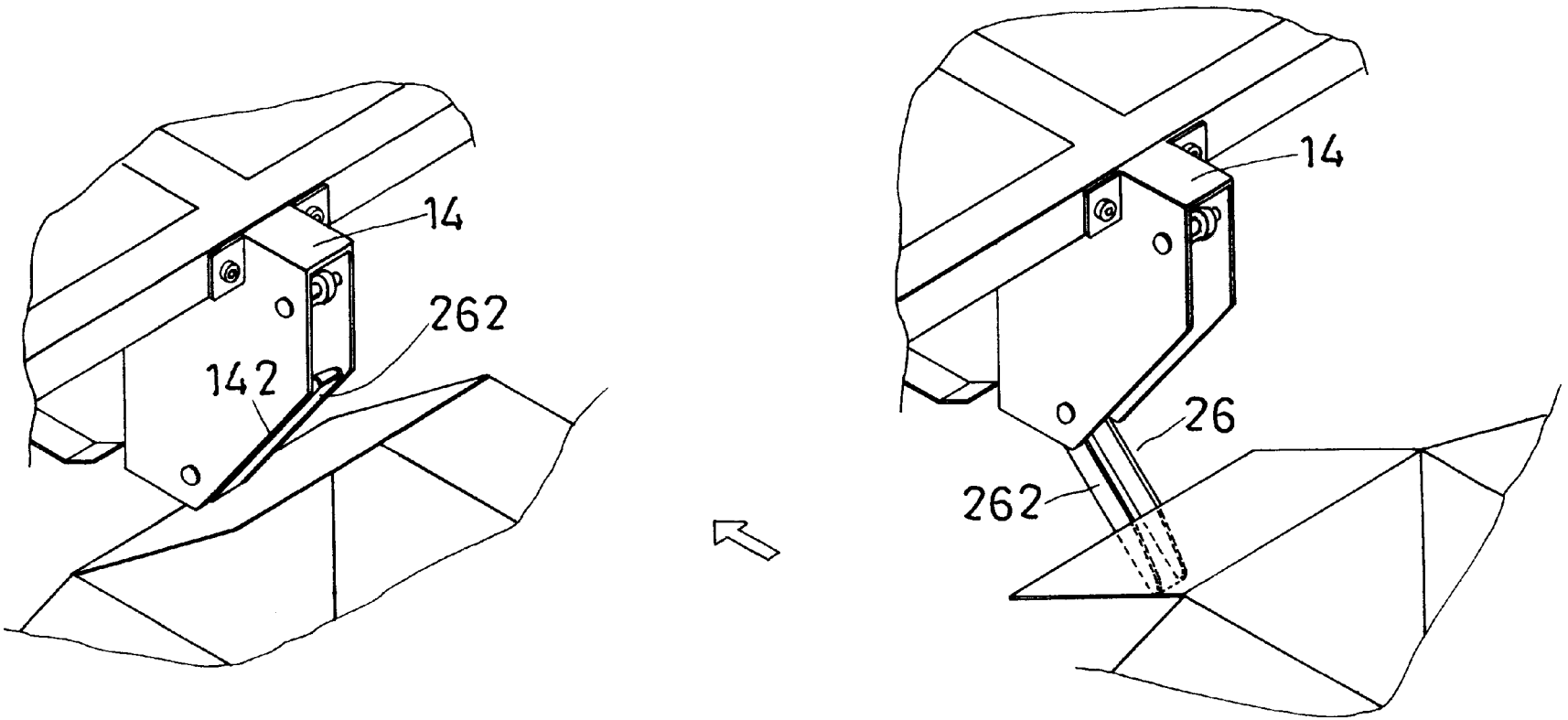
FIG. 11 is a perspective view of a push arm of an push arm unit of the folding device of the present invention, showing it swinging up a front cap.
Figure 12:
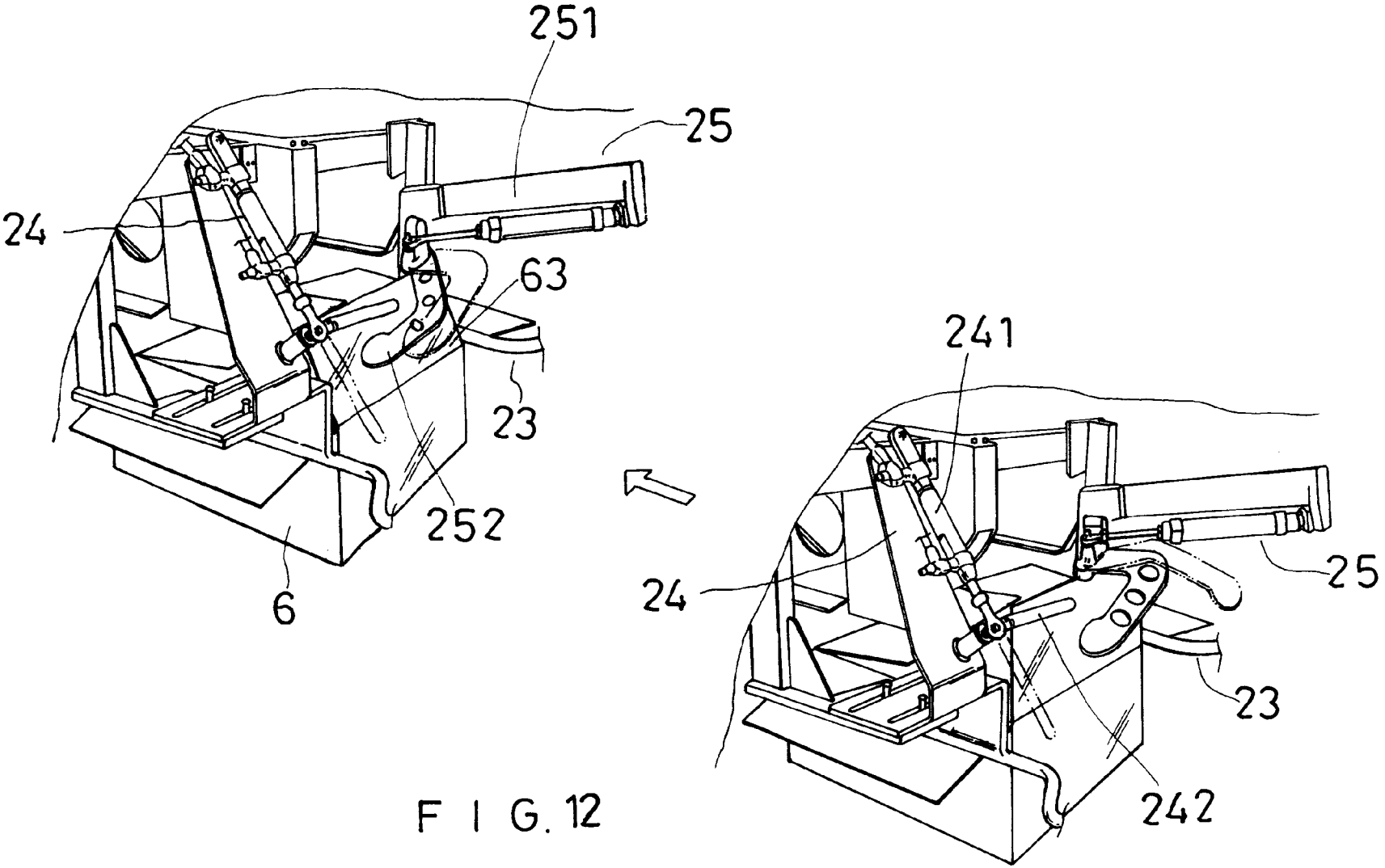
FIG. 12 is a perspective view of a folding guide rod, an upper swing rod unit and a side pressing unit of the folding device of the present invention, showing them folding down a rear cap.
Figure 14:
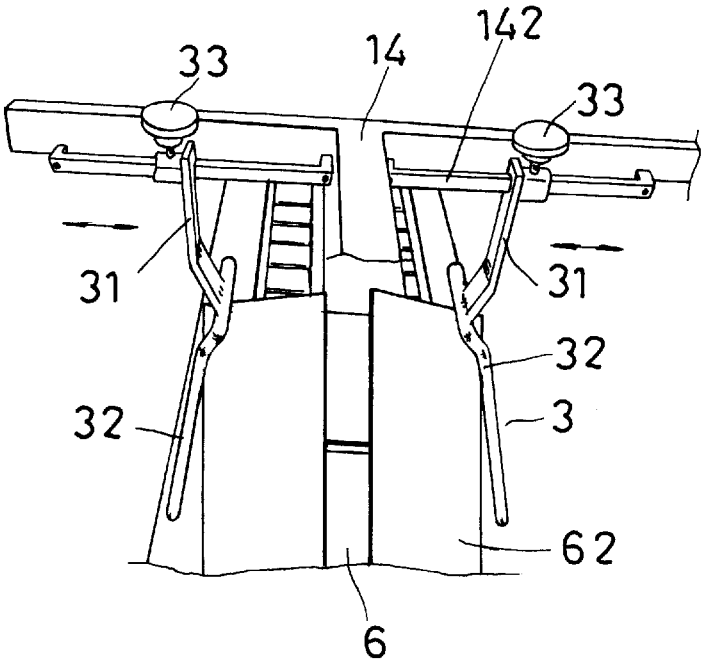
FIG. 14 is perspective view of the first cap frame of the present invention, showing it folding down two side caps; and, FIG. 15 is a perspective view of a second cap frame of the present invention, showing it moving from a first stage to a second stage.
Figure 13:
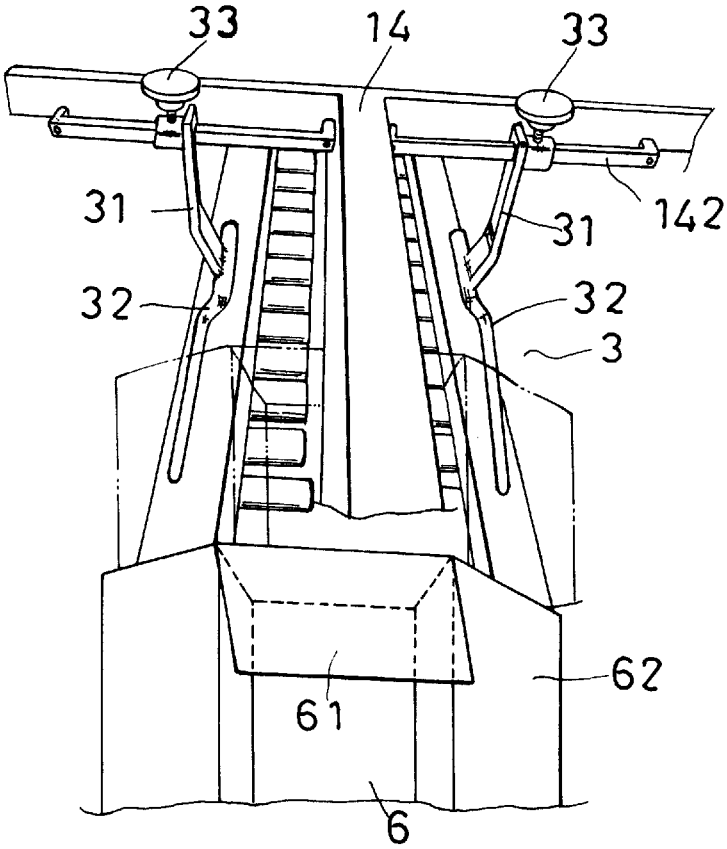
FIG. 13 is a perspective view of the first cap frame of the present invention, showing it swinging up two side caps.
Figure 15:
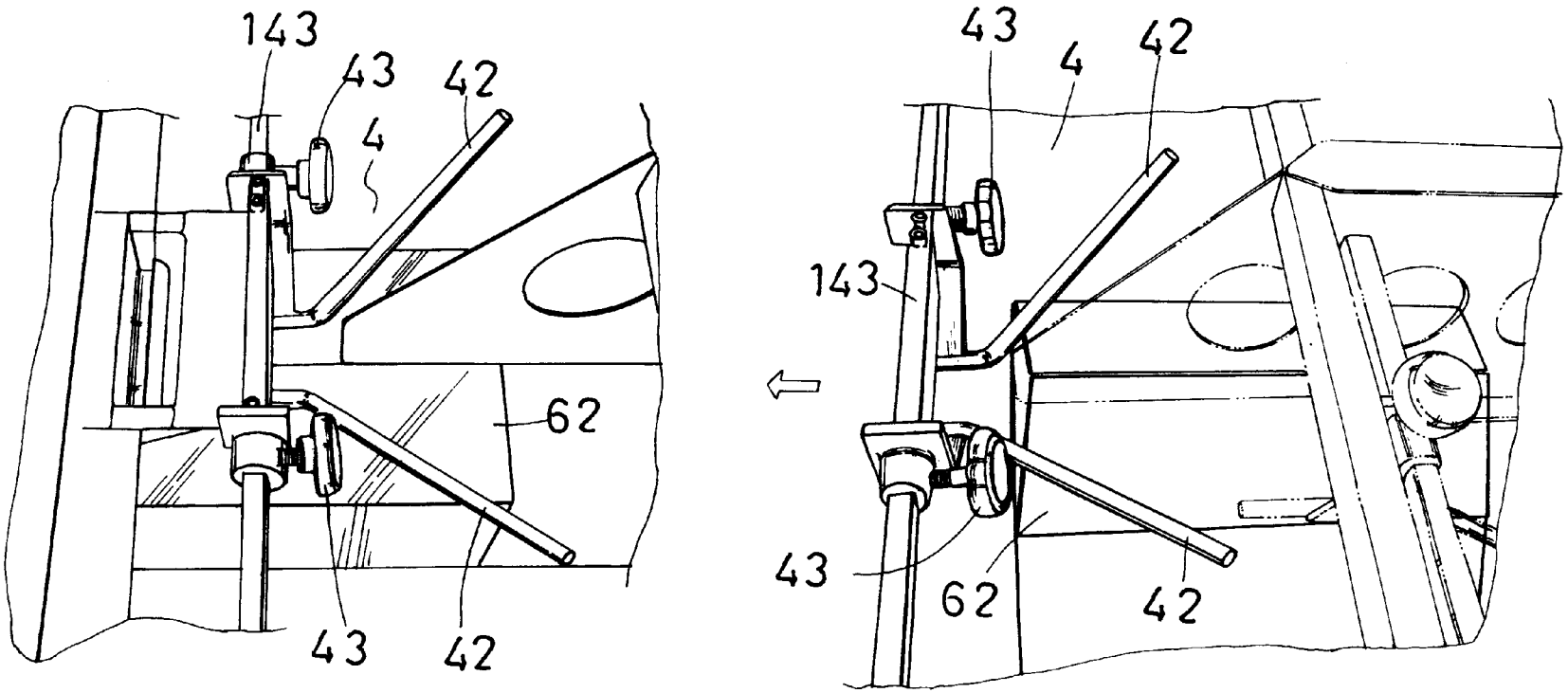

Referring to FIG. 10, a carton 6 enters the table 1 and is caught between the hold frames 13, 13 and carried forward, and in the meantime the extensions 235, 235 of the two folding guide rods 23, 23 move through two gaps between the front cap 61 and two side caps 62, 62 of the carton. Then the two side caps 62, 62 are forced to swing outward by the position sections 234, 234 of the two guide rods 23, 23, with the carton 6 further moving on the table 1. When the front cap 61 moves in the push arm unit 26, the third air cylinder 261 starts to operate, lifting the front cap 61 to the preset height. Then as the carton 6 moves on, the front cap 61 contacts the sloped surface 142 of the upper frame 14 and is folded rearward as shown in FIG. 11. In the meantime, the swing rod 242 of the upper swing rod unit 24 lifts the rear cap 63 to the preset height by operation of the first air cylinder 241, and then the press arm 252 of the side pressing unit 25 presses forward the rear cap 62 pushed by the swing rod 242 to fold down onto the opening of the carton 6, as shown in FIG. 12. Now, the carton 6 with all the caps 61, 62, 62, 63 folded moves in the second cap frame 4, guided by the two guide rods 42, 42 of the second cap frame 4, and moves in the double sealing device 5, as shown in FIG. 15, to be sealed on the upper side and the lower side by the upper and the upper slide base 51 and the lower position base 52.

As the double sealing device 5 in the invention consists of the two upper cases 514, 514 and two lower cases 523, 523 for disposing the two upper main sealing members 5143, 5143 and the lower main sealing members 5233, 5233 and the adhesive tape 5145, 5235, the sensors 5146, 5236 may sense and send signals to control the two seventh air cylinders 5122, 5122 and the two sixth air cylinders 5213, 5213 to operate in due time for moving the whole slide seats 513, 522 so that one of the upper main sealing members 5143, 5143 and one of the lower main sealing member 5233 may move to the sealing position to continue sealing action when the adhesive tapes 5145, 5235 of the other upper and the lower main sealing member 5233 are used up or ripped off, without need of stopping the whole device for replacing adhesive tapes, and capable to continue sealing operation. Then the used-up tapes may be in due time replaced with new ones for next operation.

The cap-folding and sealing machine for common or retrieved cartons in the present invention, can perform automatically cap folding and sealing operation, without need of workers to operate it, elevating operative effect, lowering cost and stepping up competitiveness in production.

While the preferred embodiment of the invention has been described above, it will be recognized and understood that various modifications may be made therein and the appended claims are intended to cover all such modifications which may fall within the spirit and scope of the invention.

What is claimed is:

1. A cap-folding and sealing machine for common or retrieved cartons comprising a table, a cap folding device, a first cap frame, a second cap frame, and a double sealing device;

said table having a preset shape, a plurality of castors provided at lower ends of feet, a plurality of rollers provided on an upper surface, a pair of two lengthwise hold frames on said rollers and the distance between said two hold frames adjustable by means of adjusting wheels combined with a threaded rod with two sections of threads respectively at a left side and a right side, said two threads having mutually opposite directions; an upper frame mounted on said table for positioning said cap folding device, said first cap frame and said second cap frame, said upper frame having a sloped surface in a front side, a first guide rod located at an intermediate portion and a second guide rod located at a rear end; a rear frame located behind said table for assembling said double sealing device;

said cap folding device having a combine plate, a combine frame, two folding guide rods, an upper swing rod unit, a side pressing unit and a push arm unit; said combine plate and said combine frame fixed at both sides of a front end of said upper frame, said two folding guide rods respectively extending in a left and a right side and having a proximal position portion and an intermediate portion and a distal portion extending a little upward and inward and combined under said combined plate and said combine frame, the distance between said two folding guide rods being adjustable to the size of a carton to be folded, a push plate fixed on said intermediate and distal portion; said upper swing rod unit having a first air cylinder fixed on said upper frame and a swing rod having one end pivotally connected with said combine frame; said side pressing unit having a second air cylinder fixed on an inner side of said combine frame and a press arm connected pivotally with a piston rod of said second air cylinder and having one end pivotally connected with said combine frame; said push arm unit having a third air cylinder and a push arm, said air cylinder having one end fixed in a hollow body of said upper frame and its piston rod pivotally connected with said push arm, and said push arm having its inner end pivotally connected in said hollow body of said upper frame;

said first cap frame having two extension plates respectively connected with a cap pressing rod, said two extension plates combined insertedly with said first guide rod of said upper frame, said cap pressing rod extending down at an angle and outward from each said extension plate, and the distance between said two extension plates being adjustable;

said second cap frame having two position plates respectively connected with a guide rod extending down, each said position plate having its upper end fitted insertedly on said second guide rod of said upper frame, the distance between said two guide rods being adjustable;

said double sealing device having an upper slide base and a lower position base, said upper slide base having two upper cases moved horizontally respectively by a fifth air cylinder and up and down by a sixth air cylinder so that an upper main sealing member in said upper case may perform tape sealing action, said lower position base having two lower cases moved respectively horizontally by a seventh air cylinder and vertically by an eighth air cylinder so that a lower main sealing member in each said lower case may perform tape sealing action, said upper slide base movable up and down by a fourth air cylinder so that one of said two upper cases with a new adhesive tape may be moved to the operative position to take place of the other one with the adhesive tape used up or ripped off;

said two hold frames catching and moving a carton forward when the carton enters said table, said two folding guide rods sticking into the gaps between a front cap and two side caps as the carton is moved forward and then swinging outward the two side caps, said swing rod unit, said side pressing unit and said push arm unit respectively swinging and pressing down the front cap and the rear cap, said first cap frame swinging and folding the two side caps down to complete cap folding operation when the carton moves therein, said second cap frame guiding the carton with all the caps folded into said double sealing device, said double sealing device sealing adhesive tapes on the upper surface and the lower surface of the carton to finish sealing action.

2. The cap-folding and sealing machine for common or retrieved cartons as claimed in claim 1, wherein the distance between said two folding guide rods of said folding device is adjusted by a thumb screw fitting in a long slot formed in a position plate.

3. The cap-folding and sealing machine for common or retrieved cartons as claimed in claim 1, wherein the distance between said two cap pressing rods of said first cap frame is adjusted by a thumb screw disposed on said extension plate.

4. The cap-folding and sealing machine for common or retrieved cartons as claimed in claim 1, wherein the distance between said two guide rods of said second cap frame is adjustable by a thumb screw disposed on said position plate.

5. The cap-folding and sealing machine for common or retrieved cartons as claimed in claim 1, wherein said upper slide base of said double sealing device comprises two side plates, two lateral frames, two slide seats, and two upper cases.

6. The cap-folding and sealing machine for common or retrieved cartons as claimed in claim 5, wherein said two side plates of said upper slide base respectively have a sliding sleeve fitting around a vertical slide rod of a support rod unit so that said upper slide base may be wholly moved up and down by means of two fourth air cylinders.

7. The cap-folding and sealing machine for common or retrieved cartons as claimed in claim 6, wherein said lateral frame of said upper slide base is combined with a fifth air cylinder to move said slide seat wholly in a horizontal direction.

8. The cap-folding and sealing machine for common or retrieved cartons as claimed in claim 6, wherein a sixth air cylinder is mounted respectively on each said slide seat and connected with each said upper case, and a small slide rod is provided to combine with a slide sleeve of each said upper case so that each said upper case may be moved up and down by each said sixth air cylinder.

9. The cap-folding and sealing machine for common or retrieved cartons as claimed in claim 6, wherein each said main sealing member is supported by two support rods in said upper case, and a socket is fixed on a proper location on said upper case for connecting a sensor to check if a adhesive tape is used up or ripped off.

10. The cap-folding and sealing machine for common or retrieved cartons as claimed in claim 1, wherein said lower position base consists of two plate frames, two slide plates, and two lower cases.

11. The cap-folding and sealing machine for common or retrieved cartons as claimed in claim 10, wherein said plate frame of said lower position base is fixed with said table, having two lateral parallel frames respectively fixed a guide rail combined with a slide sleeve fixed on said slide plate so that said slide plate may be moved horizontally by means of a seventh air cylinder disposed on one of said lateral frame.

12. The lower position base as claimed in claim 11, wherein an eighth air cylinder is provided under said slide plate and connected with each said lower case, and a slide sleeve fixed on a rear side of each said lower case is combined with a slide rod so that each said lower case may be moved up and down by said eighth air cylinder.

13. The lower position base as claimed in claim 11, wherein each said lower sealing member is disposed in each said lower case of said lower position base by means of two support rods, and a socket is fixed on each said lower case for connecting a sensor to check if a adhesive tape is used up or ripped off.

* * * * *